US005472248A

United States Patent [19]

Flowerday

[11] Patent Number: 5,472,248

[45] Date of Patent: Dec. 5, 1995

[54] SURFACE /CREMONE BOLT

[75] Inventor: Dale L. Flowerday, Holland, Mich.

[73] Assignee: Chautauqua Hardware Company, Jamestown, N.Y.

[21] Appl. No.: 181,232

[22] Filed: Jan. 13, 1994

[51] Int. Cl.[6] ..... E05C 1/04

[52] U.S. Cl. ..... 292/147; 292/145

[58] Field of Search ..... 292/145–148, 292/DIG. 51, DIG. 53, 337, 137; 384/20, 23, 42

[56] References Cited

U.S. PATENT DOCUMENTS

| | | | |
|---|---|---|---|
| 1,776,580 | 9/1930 | Deasy | 292/145 |
| 2,100,622 | 11/1937 | Adams | 292/147 |
| 2,620,213 | 12/1952 | Keeler | 292/147 |
| 3,141,692 | 7/1964 | Behrens | 292/147 |
| 4,021,063 | 5/1977 | Porter | 292/67 |
| 4,060,266 | 11/1977 | Wilkinson | 292/148 |
| 4,331,369 | 5/1982 | Lazar et al. | 384/23 |

*Primary Examiner*—Peter M. Cuomo
*Assistant Examiner*—Tuyet Pham
*Attorney, Agent, or Firm*—Varnum, Riddering, Schmidt & Howlett

[57] ABSTRACT

A self-centering surface bolt comprising two or more keepers, a surface bolt and two or more guides. The guides further comprise a base, a stem and a cap. The base of the guide is received within a recess in the keepers and the stem and cap of the guides are received within a channel in the surface bolt. The guides are symmetrical with respect to the channel of the surface bolt. Thus, regardless of the position of the guide with respect to the keepers or the surface bolt, the guides will have the same apparent cross section and will center the surface bolt within the keepers without resulting in the surface bolt binding with respect to the guides.

3 Claims, 3 Drawing Sheets

SURFACE/CREMONE BOLT

BACKGROUND OF THE INVENTION

Field of the Invention

This invention relates to door hardware and, more specifically, to a surface/cremone bolt for locking a door.

Description of the Prior Art

Surface bolts have long been used for locking a door with respect to the surrounding frame and wall. Generally, the surface bolt comprises multiple keepers having an arcuate cross section and mount to the door to define a channel in which a surface bolt is slidable. The keeper channel defines a longitudinal axis along which the surface bolt moves. The surface bolt has a knob for actuating the surface bolt and the interior of the surface bolt defines a channel in which a guide is received. The guide sets within a recess in the keeper and has an extension which is disposed within the channel of the surface bolt. The extension defines an aperture in which a spring and a ball bearing are disposed. The spring forces the ball bearing to contact the surface of the inner wall of the surface bolt.

Typically, a mortise strike plate is mounted to the door jamb adjacent the door and in alignment with the surface bolt so that by sliding the surface bolt with the handle, the surface bolt will extend into the mortise strike on the wall and lock the door with respect to the wall. Previous surface bolts are susceptible to binding because the clearance between the keeper, surface bolt and guide is great enough that the surface bolt can veer away from the longitudinal axis and bind with respect to the keepers and the surface bolt. Thus, it is desirable to make a surface bolt that is self-centering to avoid the binding during movement of the surface bolt.

A cremone bolt is similar to a surface bolt but has two bolts connected by a handle that activates both bolts on rotation or movement of the handle. One bolt extends upwardly from an upper portion of a door and the other bolt extends downwardly from a lower portion of a door into a strike plate in a door jamb. The construction of the cremone bolt assembly is similar to the surface bolt assembly discussed above, especially with respect to the bolt and guides.

SUMMARY OF THE INVENTION

The invention relates to a bolt assembly for locking a door. The bolt assembly comprises keepers adapted for mounting to a door and for guiding an elongated rod having a longitudinal axis. A hollow elongated channel having an elongated opening is disposed on the underside of the elongated rod. Guides, having a protrusion, are slidably received within the hollow elongated channel of the elongated rod, and are adapted to be mounted with the keepers when the keepers are mounted to the door. The guide protrusion has a stem portion with a substantially circular shape so that the cross sectional area of the stem portion is always substantially the same regardless of the orientation of the guide about an axis perpendicular to the longitudinal axis of the elongated rod to minimize the binding between the guides and the elongated rod when the elongated rod is moved.

Preferably, the guides comprise a circular base and the keepers have a circular cross sectional recess on the underside for receiving the circular base of the guides. The guides float within the keepers so that the guides are self-centering with respect to the keepers. The stem portion of the protrusion extends from the circular base and has a cap the same relative shape of the channel of the rod extending from an upper portion of the stem portion. The cap has a diameter smaller than the width of the elongated opening so that the guide is slidably retained within the hollow elongated channel of the elongated rod. The stem portion corresponds with the elongated opening in the hollow elongated channel.

The bolt assembly can be incorporated into a surface bolt assembly or a cremone bolt assembly.

BRIEF DESCRIPTION OF THE DRAWINGS

For a more complete understanding of the invention reference should now be had to the accompanying drawings in which.

DETAILED DESCRIPTION OF THE PREFERRED EMBODIMENTS

Figures 1, 2:
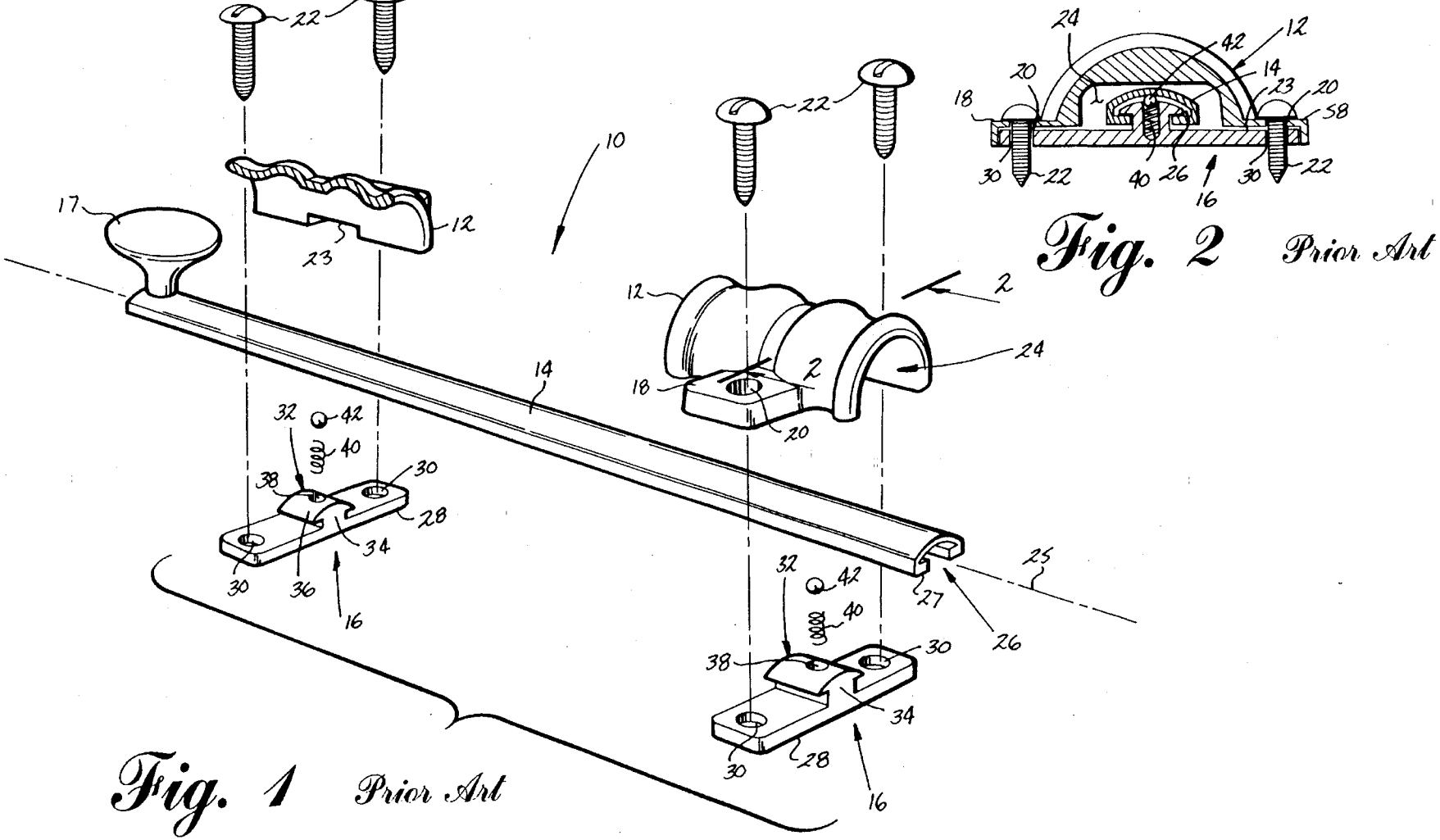
Fig. 2 Prior Art
Fig. 1 Prior Art
FIG. 1 is an exploded view of a prior art surface bolt assembly partially broken away.
FIG. 2 is a sectional view taken along line 2—2 of FIG. 1.

FIG. 1 illustrates a prior art surface bolt assembly 10 comprising keepers 12, surface bolt 14 and guides 16. The keepers 12 have opposed tabs 18 extending outwardly. The tabs 18 have screw apertures 20 with which the keepers 12 are mounted to the door (not shown) by screws 22 passing through the screw apertures 20 and into the door. A recess 23 is formed in the underside of the tabs 18. The recess 23 encompasses the screw apertures 20. The recess 23 is larger than the, guides 16 because the guides 16 are typically manufactured with low tolerances and the recess 23 must receive varying sizes of guides 16, resulting in a low tolerance fit of the guides 16 in the recess 23.

A surface bolt channel 24 is formed by the keepers 12 and receives the surface bolt 14. The surface bolt 14 has a longitudinal axis 25 and has a hollow interior defining a guide channel 26 with an elongated slot 27 and in which a portion of the guides 16 are received. A knob 17 is mounted to one end of the surface bolt 14. The guides 16 comprise an elongated guide base 28 having opposed screw apertures 30 and from which a surface bolt guide 32 extends. The screw apertures 20 and 30 are oversized with respect to the diameter of the screws 22 to ensure the screws will pass through the screw apertures 20 and 30. The surface bolt guide 32 comprises a rectangular flange 34 topped by an arcuate cap 36 having a rectangular shape in plan view and an arcuate cross section. A spring aperture 38 is disposed within the rectangular flange 34 in the arcuate cap 36 and receives a spring 40 and a ball bearing 42.

Referring to FIGS. 1 and 2, to assemble the prior art surface bolt assembly 10, the spring 40 is inserted into the spring aperture 38 of each guide 16 and followed by a ball bearing 42. Each assembled surface bolt guide 32 is slidably mounted within the guide channel 26 of the surface bolt 14 so that the rectangular flange 34 slides within the elongated slot 27 and the cap 36 is disposed above the elongated slot 27 to keep the guides 16 within the channel 26. The keepers 12 are; mounted over the surface bolt 14 so that the elongated guide base 28 of the guides 16 are received within the guide recess 23 of the keepers 12. The keepers 12 are aligned with the guides 16 so that the screw apertures 20 of the keepers and the screw apertures 30 of the guides are aligned and screws 22 pass through the aligned screw apertures 20 and 30 to fasten the surface bolt assembly 10 to the door.

When assembled, the surface bolt guide 32 centers the guide with respect to the longitudinal axis 25 of surface bolt channel 24. For the guides 16 to properly align, the guide base 28 is oriented perpendicular to the longitudinal axis 25. However, it is known that the surface bolt 14 can bind with respect to the guides 16. The surface bolt 14 tends to bind for several reasons. First, the low tolerance fit between the guides 16 and the recess 23 of the keepers 12 results in the base 28 moving within the recess 23 so that the rectangular flange 34 has an apparent cross section larger than its actual cross section and the rectangular flange 34 contacts the walls of the elongated slot 27 and binds with respect to the surface bolt 14. Depending on the shape of the cap 36, it is possible the cap will also contact the walls of the channel 26 and bind with respect to the surface bolt 14. Further, the oversized screw apertures 20 and 30 also result in the guides 16 moving within the recess during movement of the surface bolt 14. The screw apertures 30 can exacerbate the binding of the guides 16 with respect to the surface bolt 14 by orienting the base 28 at an angle not perpendicular to the longitudinal axis of the surface bolt 14, resulting in the flange 34 and cap 36 having an apparent cross section larger than the actual cross section.

Figure 3:
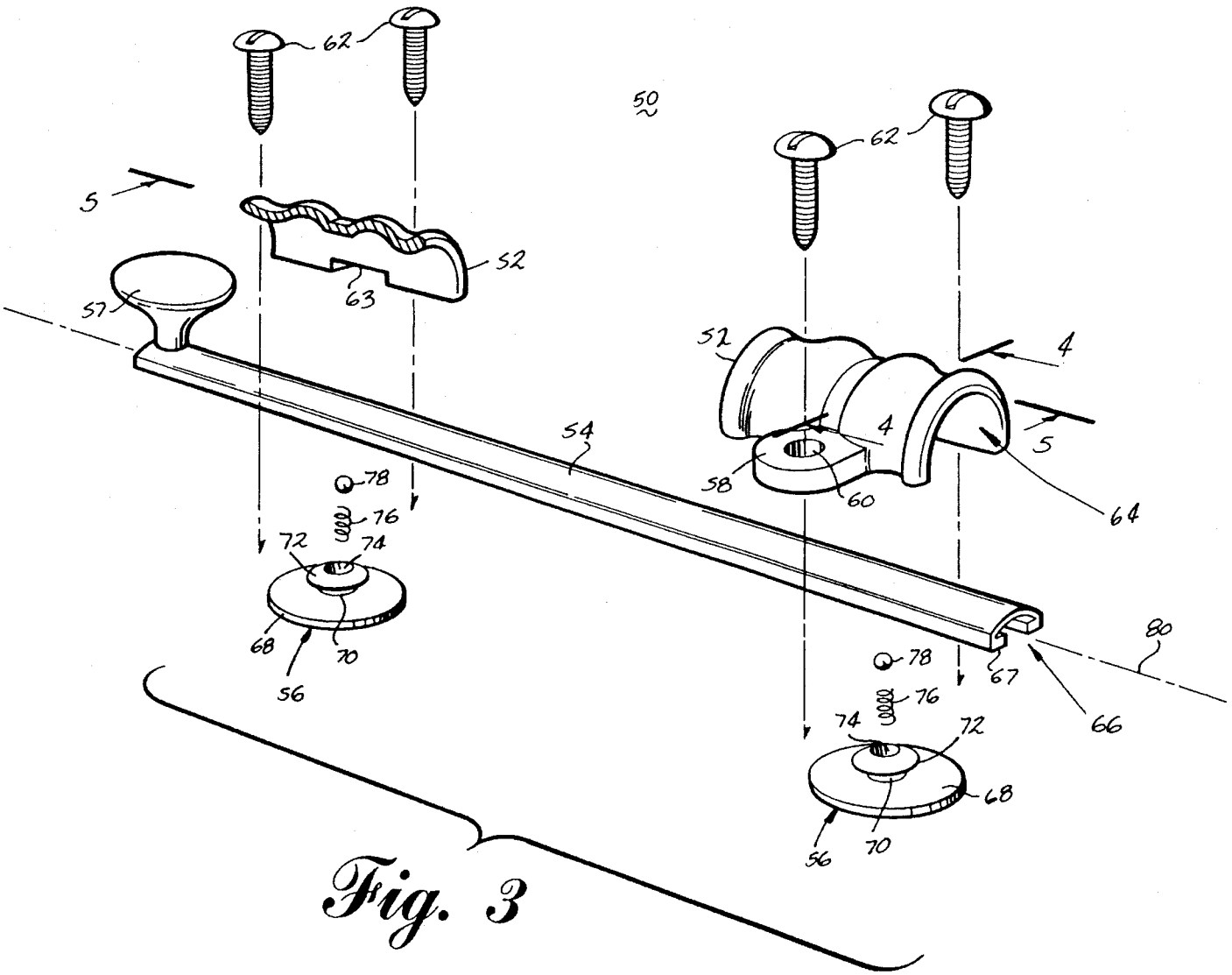
FIG. 3 is an exploded view of the surface bolt assembly according to the invention partially broken away.
Figure 4:
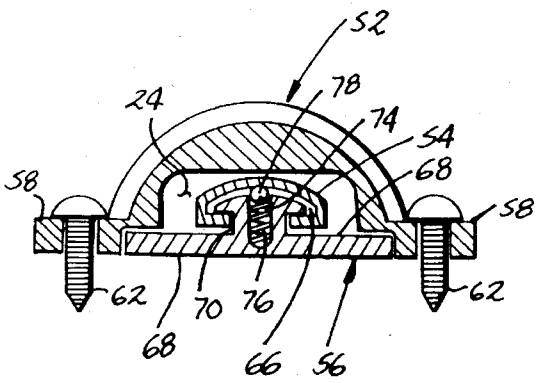
FIG. 4 is a sectional view taken along line 4—4 of FIG. 3.

Applicant's invention overcomes the binding propensity of the prior art surface bolt by incorporating a guide whose apparent cross sectional area remains constant regardless of the position of the guide with respect to a longitudinal axis of the surface bolt. Applicant's surface bolt assembly 50 is illustrated in FIG. 3. The surface bolt assembly 50 comprises two or more keepers 52, a surface bolt 54 and two or more guides 56. The keepers 52 can have any desired ornamental shape and are generally arcuate in cross section, but are preferably complementary to the cross section of the surface bolt 54. The keepers 52 further comprise tabs 58 extending outwardly from the keepers 52. Each tab 58 has a screw aperture 60 for receiving a screw 62 to mount the keepers 52 to the door. The keepers 52 define a surface bolt channel 64 for receiving the surface bolt 54. A recess 63 is formed in the keepers 52, but does not encompass the screw apertures 60.

Figure 5:
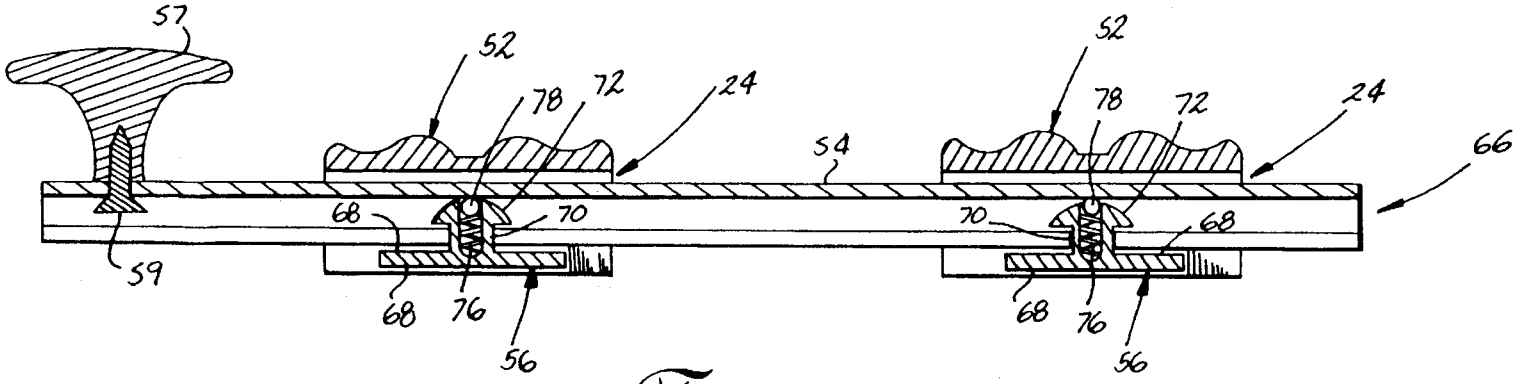
FIG. 5 is a sectional view taken along line 5—5 of FIG. 3.

The surface bolt 54 has a longitudinal axis 80 and can have any desired cross section, but preferably has a C-shaped cross section, which defines a mushroom-shaped guide channel 66 for receiving a portion of the guides 56. The surface bolt channel has a slot 67 for receiving the guides 56. One end of the surface bolt 54 mounts a knob 57 for actuating the surface bolt 54. The knob 57 is preferably affixed by a screw 59 passing through the surface bolt 54 and into the knob 57 (FIG. 5). The screw 59 also acts as a stop to prevent the inadvertent removal of the surface bolt 54 during use.

The guides 56 comprise a circular base 68, which is received within the recess 63 of the keepers 12. Extending from the circular base 68 is a stem 70 having a circular cross section topped by a cap 72 also having a circular cross section. A spring aperture 74 extends through the circular cap 72 and into the stem 70 and receives a spring 76 and a ball bearing 78.

To assemble the surface bolt 50, the spring 76 and ball bearing 78 are inserted into the spring aperture 74 of each guide 515. The stem 70 and circular cap 72 of each guide 56 are inserted into the mushroom-shaped guide channel 66. Because the stem 70 is circular in cross section, instead of elongated like the prior art, the size of the bearing surface between the surface bolt 54 and the guides 56 is much less than the bearing surface of the prior art, reducing the friction associated with movement of the guide. The keepers 52 are mounted over the surface bolt 54 so that the circular base 68 of each guide 56 is received within the recess 63 of the keepers 52. Screws 62 are passed through the screw aperture 60 and threaded into the door to mount the keepers 52 to the door. Because the circular base 68 does not interact with the screw apertures 60, the alignment of the guides 56 is independent of the relationship between the screws 62 and the base 68, unlike the prior art where the alignment of the base 28 is a function of the screws 22 and screw apertures 20. Thus, the guides 56 are free to float within the recess 63. After the guides 56 are inserted into the guide channel 66, the end of the surface bolt 54 opposite the knob is crimped so that it cannot slide off of the guides 56.

The guides 56 center the surface bolt 54 with respect to the surface bolt channel 64 because the stem 70 and circular cap 72 of each guide 56 are received within the guide channel 66. The symmetry of the guides 56, resulting from the guides 56 having a circular stem and a circular cap yields a constant apparent cross section as viewed along the guide channel 66. So, regardless of the orientation of the guides 56 within the recess of the keepers 52, the cross section of the guides 56 will always be constant. Therefore, it is impossible for the guides 56 to be in an orientation in which the guide could create a larger apparent cross section that would bind with the surface bolt 54 if the guides 56 or surface bolt 54 were skewed with respect to a longitudinal axis 80 defined by the keepers 52.

Whereas the invention has been described with reference to a surface bolt assembly, the invention is equally applicable to a cremone bolt assembly in which elongated rods are slidably mounted to the surface of upper and lower portions of a door and activated by a single handle. In this type of bolt assembly, the guide, keepers and elongated bolts would be of like construction as the surface bolt assembly described above.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

I claim:

1. A bolt assembly comprising:

keepers for guiding an elongated rod and which are adapted to be mounted to a door;

the elongated rod having a longitudinal axis and a hollow elongated channel on the underside thereof with an elongated opening therein;

guides adapted to be mounted to the keepers at least when the keepers are mounted to the door, the guides having a protrusion within the hollow elongated channel of the elongated rod; the improvement comprising:

the guides comprise a circular base and the keepers have a circular recess on their underside for receiving the circular base of the guides; and the guide protrusion having a stem portion with a substantially circular shape so that the cross sectional area of the stem portion will always be substantially the same regardless of the orientation of the guide about an axis perpendicular to the longitudinal axis of the elongated rod to minimize binding between the guides and the elongated rod.

2. A bolt assembly according to claim 1 wherein the guides float within the keepers so that the guides are self-centering with respect to the keepers.

3. A bolt assembly according to claim 2 wherein the stem portion of the protrusion extends from the circular base and a cap of enlarged diameter extends from an upper portion of the stem portion and the cap has a diameter larger than the width of the elongated opening in the elongated rod so that the guide is retained within the hollow elongated channel of the elongated rod and the stem portion corresponds with the elongated opening in the hollow elongated channel.

* * * * *